US005161641A

United States Patent [19]

Nusbaum

[11] Patent Number: 5,161,641

[45] Date of Patent: Nov. 10, 1992

[54] JOINTLY MOVABLE SAFETY NET AND CURTAIN ARRANGEMENT FOR MULTI-FLOOR BUILDINGS UNDER CONSTRUCTION

[76] Inventor: Arthur Nusbaum, 1500 Palisade Ave., Fort Lee, N.J. 07024

[21] Appl. No.: 784,559

[22] Filed: Oct. 29, 1991

[51] Int. Cl.[5] ..... E04G 21/32

[52] U.S. Cl. ..... 182/138; 182/82; 182/129

[58] Field of Search ..... 182/137, 138, 139, 140, 182/129, 82

[56] References Cited

U.S. PATENT DOCUMENTS

| | | | |
|---|---|---|---|
| 3,949,834 | 4/1976 | Nusbaum | 182/138 |
| 4,732,234 | 3/1988 | Brickman | 182/82 |
| 4,805,735 | 2/1989 | Anderson | 182/138 |
| 4,838,382 | 6/1989 | Nusbaum | 182/138 |
| 4,856,615 | 8/1989 | Nusbaum | 182/138 |
| 4,892,169 | 1/1990 | Duncan | 182/138 |

*Primary Examiner*—Reinaldo P. Machado

*Attorney, Agent, or Firm*—Kirschstein, Ottinger, Israel & Schiffmiller

[57] ABSTRACT

A worker operates a winch having a handle located below a fully deployed net from a protected position in which the net shields the worker from injury. A curtain is mounted either above or below the net on support structures therefor for joint movement with the net. A close-in bracket brings the inner edge of the net closer to an outer face of a building under construction.

22 Claims, 5 Drawing Sheets

JOINTLY MOVABLE SAFETY NET AND CURTAIN ARRANGEMENT FOR MULTI-FLOOR BUILDINGS UNDER CONSTRUCTION

BACKGROUND OF THE INVENTION

1. Field of the Invention

This invention generally relates to a safety net arrangement for protecting workers and passersby from injury during construction of multi-floor buildings and, more particularly, to manually moving a deployed net, and optionally a curtain, by a worker located at a safe protected position in which the net shields the worker from injury.

2. Description of Related Art

It was known from my U.S. Pat. No. 3,949,834 to erect safety nets adjacent an outer face of a building under construction in order to catch workers and/or objects falling off a floor above the net, thereby protecting the fallen worker, workers on lower floors, as well as passersby at ground level, from being injured. The outer edge of each net was supported at an outer end of a cantilevered support pole whose inner end was connected to a floor bracket bolted to a lower floor. The inner edge of each net was bolted to the nearest higher floor by eye-bolts or by cables tied to the nearest perimeter columns.

Despite its use in many buildings under construction, the arrangement of the '834 patent was not easily movable from lower to higher floors as construction proceeded, since the net supports had to be unbolted and untied from lower floors prior to being moved, rebolted and retied on higher floors. Since the disassembled net exposed workers and passersby to potential injury from falling workers and/or objects, extra redundant nets were erected while other safety nets were being moved—a procedure which was both labor-intensive and costly.

It was also known from my U.S. Pat. No. 4,856,615 to attach elongated tracks or guide rails to a building adjacent an outer face thereof. Net support structures for suspending a safety net in a deployed condition were mounted on the guide rails for vertical movement therealong while constantly maintaining the net deployed. Manually-operated overhead winches were mounted on the guide rails above the net support structures and were connected to the latter by depending hoisting cables. To move the net support structures and, in turn, the net, a worker had to climb up to a higher floor to reach the overhead winch, thereby exposing himself or herself to the risk of injury from falling objects from above.

It was also known from my U.S. Pat. No. 4,838,382 to raise a deployed safety net without using guide rails attached to the building. Again, manually-operated overhead winches were mounted above, and connected by depending hoisting cables to, the net support structures. Again, a worker had to operate the winch from an exposed, unprotected position, thereby risking injury from falling objects from above.

The art has also proposed raising safety nets by power-assisted means. For example, U.S. Pat. No. 4,732,234 described the assistance of a power crane, and U.S. Pat. No. 4,892,169 described the assistance of hydraulic pumps and motors.

It was also known in the art to stretch curtains between, and fasten the curtains to, spaced-apart building columns or masts. For example, the curtain may be a tarpaulin to act as a weather shield, to keep heat in the building, or as a screen to keep spray paint or spray fire-proofing materials in the building. The curtain may be a safety barrier flush against the building face to prevent workers from falling off an unfinished floor, or may be an advertising banner, etc. Such curtains were held in place by cables tied around the nearest perimeter columns and were not easily movable from one floor to the next as building construction proceeded. Indeed, the cables were typically untied, the curtains folded and thereupon unfolded before being attached to the columns on another floor. This was a laborious, time-consuming procedure.

The known safety nets were also supported entirely by rigid supports. Although generally satisfactory for securely holding the nets in place and for catching objects and workers, experience has shown, particularly in the case of a fallen worker, that injury might result to a fallen worker because of the rather "hard" landing in the net due, in large part, to the rigid support structures holding the net. The rigid support structures do not readily allow the net to collapse around the fallen worker to prevent him or her from rebounding off the net.

SUMMARY OF THE INVENTION

1. Objects of the Invention

It is a general object of this invention to improve known prior art safety net and curtain arrangements.

It is another object of this invention to reliably protect workers and/or passersby from injury at all times during the course of constructing a multifloor building.

Another object of this invention is to reliably protect a worker during the course of raising or lowering a deployed safety net.

A further object of this invention is to jointly move a curtain together with movement of the safety net.

An additional object of this invention is to provide a resiliently-yielding "soft" landing for a fallen worker.

Still another object of this invention is to lessen the overall costs of building construction both in terms of labor and time while not sacrificing or compromising worker safety.

2. Features of the Invention

In keeping with these objects, and others which will become apparent hereinafter, one feature of this invention resides, briefly stated, in a safety net arrangement for multi-floor buildings under construction, comprising a safety net having opposite end regions, a pair of movable support structures, each supporting a respective end region of the net for suspending the net in a deployed condition in which the net extends generally away from an outer face of a building under construction over a predetermined distance, and a plurality of guides mounted on the building adjacent the outer face for guiding the support structures for vertical movement along the outer face.

Another feature of this invention resides in a pair of manually-operated winches, each operatively connected to a respective support structure, for manually moving the support structures independently of each other and in alternate succession to different elevations, while maintaining the net in the deployed condition during each movement. Put another way, the opposite end regions of the net "walk" up the building. Each winch has a handle located below the deployed net to enable a worker to operate the winch from a safe protected position in which the overhead deployed net shields the worker from injury due to falling objects and/or workers from above. No longer need the worker operating the winch have to climb to an exposed, unprotected, overhead location.

In a preferred embodiment of this invention, each support structure has an upright, elongated support operatively connected to an inner edge of the net and positioned adjacent the outer face of the building, as well as a cantilevered support on the upright support and extending generally outwardly therefrom away from the outer face. The cantilevered support is operatively connected to an outer edge of the net. Each support structure includes a flexible cable having one end connected to a respective upright support, and an opposite end connected to a respective cantilevered support. Each flexible cable extends downwardly from the respective upright support to a central region of the respective cantilevered support. The flexible cable provides a "softer" landing, and lessens the tendency of workers or objects to rebound from the net.

Another feature of this invention resides in mounting a curtain on the net support structures for joint movement therewith. The curtain may be mounted above or underneath the net. The curtain may contain graphics such as advertising. Once mounted on the support structures, the curtain need not be removed, folded, unfolded and reattached to building columns. The curtain is preferably stretched taut flush against the outer building face.

Still another feature relates to bringing the inner edge of the net as close as possible to the outer building face. Too large a gap between the inner net edge and the outer building face poses a safety risk that smaller-sized objects, e.g. rivets, tools, etc., can fall through such a gap.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a broken-away, side sectional view taken on line 3—3 of FIG. 1;

DETAILED DESCRIPTION OF THE PREFERRED EMBODIMENTS

Figure 1:
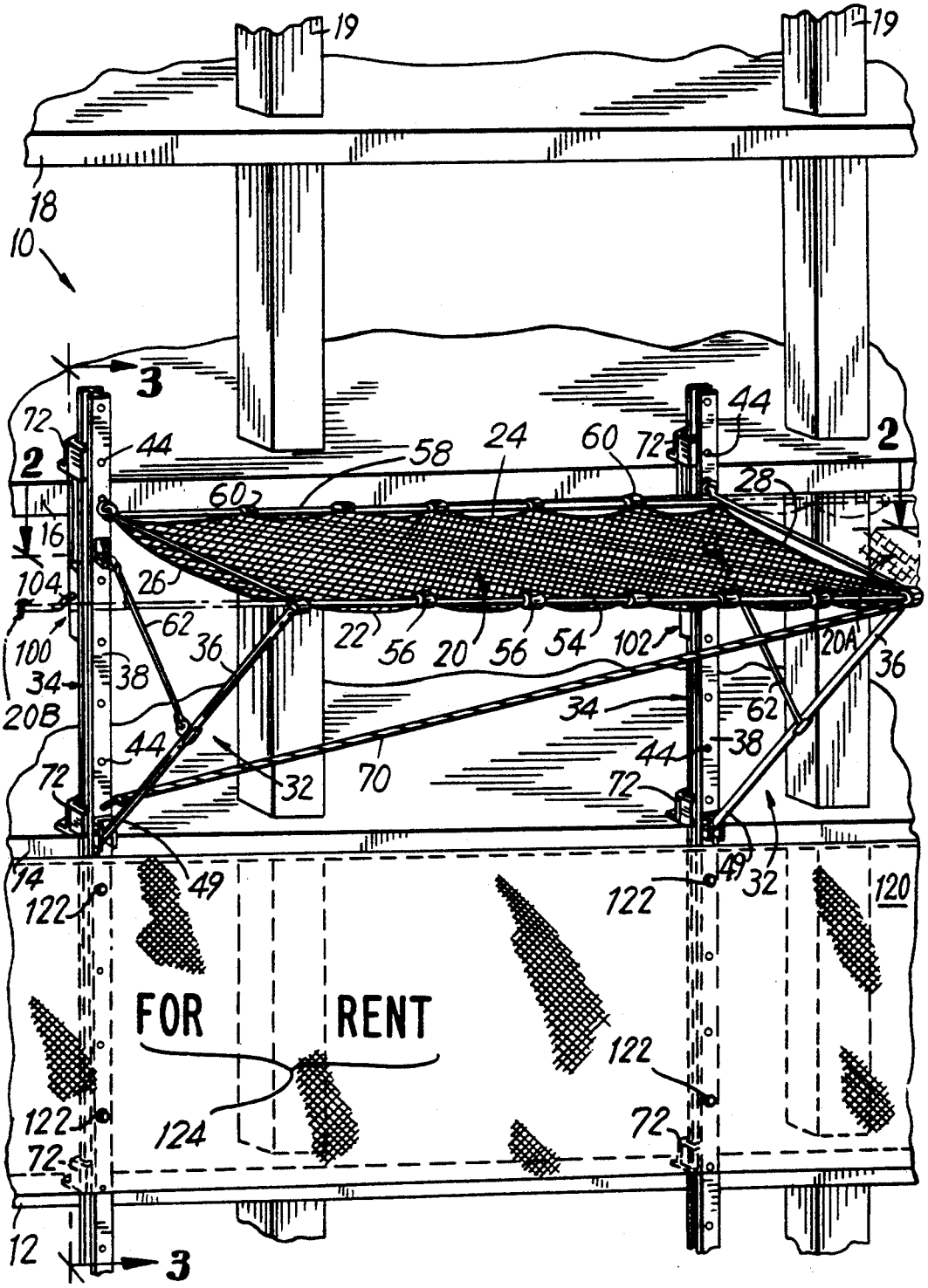
FIG. 1 is a front, perspective view of a safety net and curtain arrangement according to the present invention, as attached to a partly broken-away, perspective view of a multi-floor building under construction.
Figure 2:
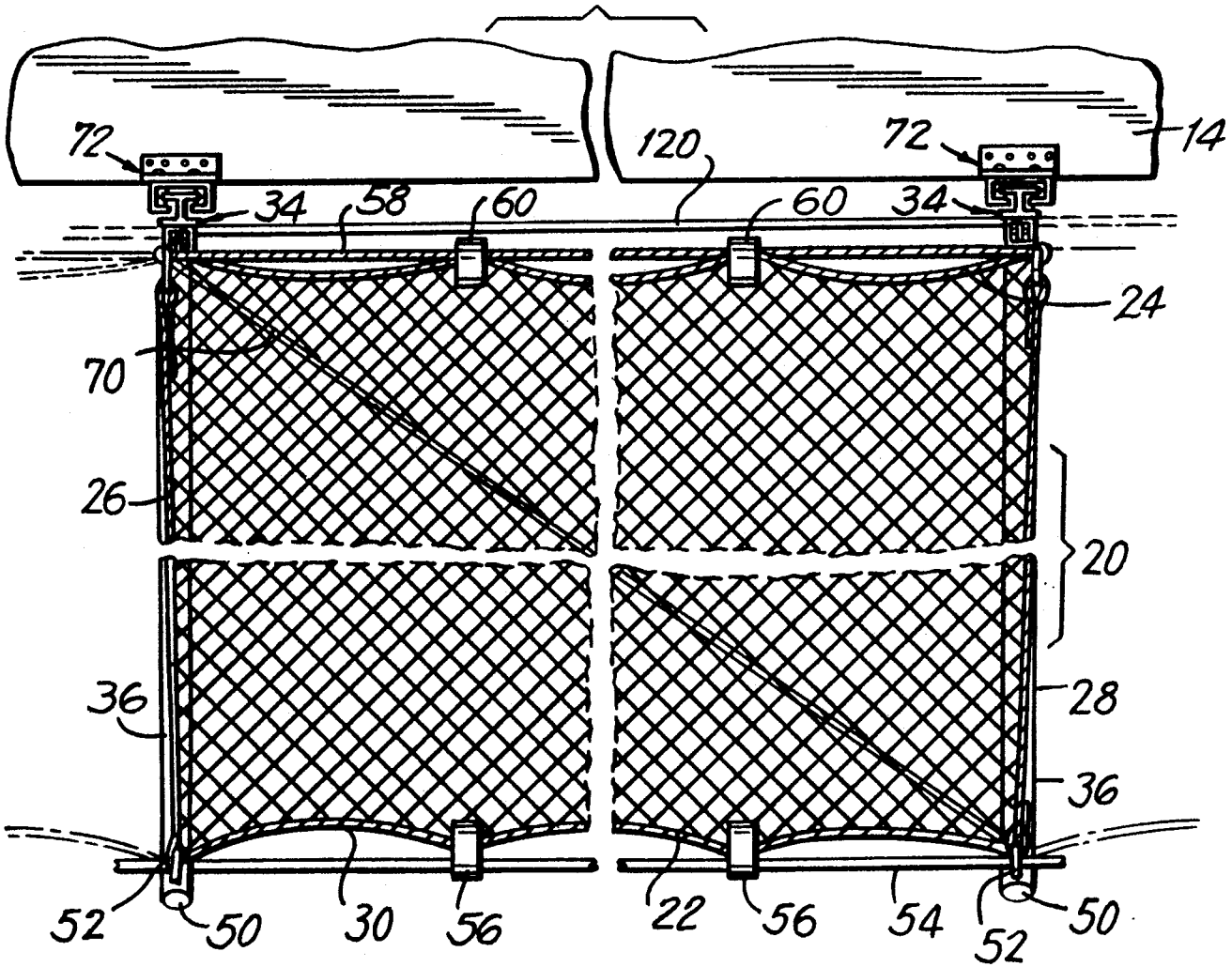
FIG. 2 is a broken-away, top plan view taken along line 2—2 of FIG. 1.

Referring now to the drawings and, more particularly, to FIGS. 1-3 thereof, reference numeral 10 generally identifies a multi-floor building under construction. Building 10 has floors 12, 14, 16, 18 in ascending order, as well as building columns 19 shown in broken-away view. Only a portion of one side of building 10 has been shown in order to illustrate the invention. However, it will be expressly understood that this invention may be used in connection with buildings having many more than four floors and, of course, more than one side.

A safety net 20 is suspended adjacent an outer face of building 10. The net 20 comprises a net fabric having an outer edge 22 further from the external or outer face of the building, an inner edge 24 closer to the outer building face, and a pair of end edges 26, 28. Net 20 has a reinforced rope or cable edging 30 which extends peripherally along each edge 22, 24, 26, 28. In a preferred embodiment, net 20 has a generally rectangular configuration, and is about 25 ft. long and about 15 ft. in width.

Support means, including a pair of support structures 32, are located at opposite end regions of the net underneath the end edges 26, 28. The support structures 32 are operative for suspending the net in a fully deployed condition in which the net extends generally outwardly away from the outer building face in a generally horizontal plane relative to the building over a predetermined distance of "reach".

Each support structure includes an upright elongated support 34 positioned adjacent the outer building face, and having a length which advantageously spans about two to three floors. Each support 34 is advantageously comprised of two or more sections 34A, 34B connected in end-to-end relationship and interconnected by a strap flange 35 (see FIG. 3). The support 34 advantageously has an H-shaped cross-section (see FIG. 7), and is composed of two generally parallel outer and inner flanges 38, 40 interconnected by a web 42. A plurality of holes 44 (see FIG. 3) are formed through each inner and outer flange, each hole being spaced apart of one another lengthwise along the support 34. A floor stop or abutment 46 is also provided on each support. Each abutment 46 is removably repositionable lengthwise along its support 34. Each abutment 46 is an L-shaped bracket anchored in place, preferably by a removable bolt mounted in a hole 44 above a respective floor.

Figures 4, 5:
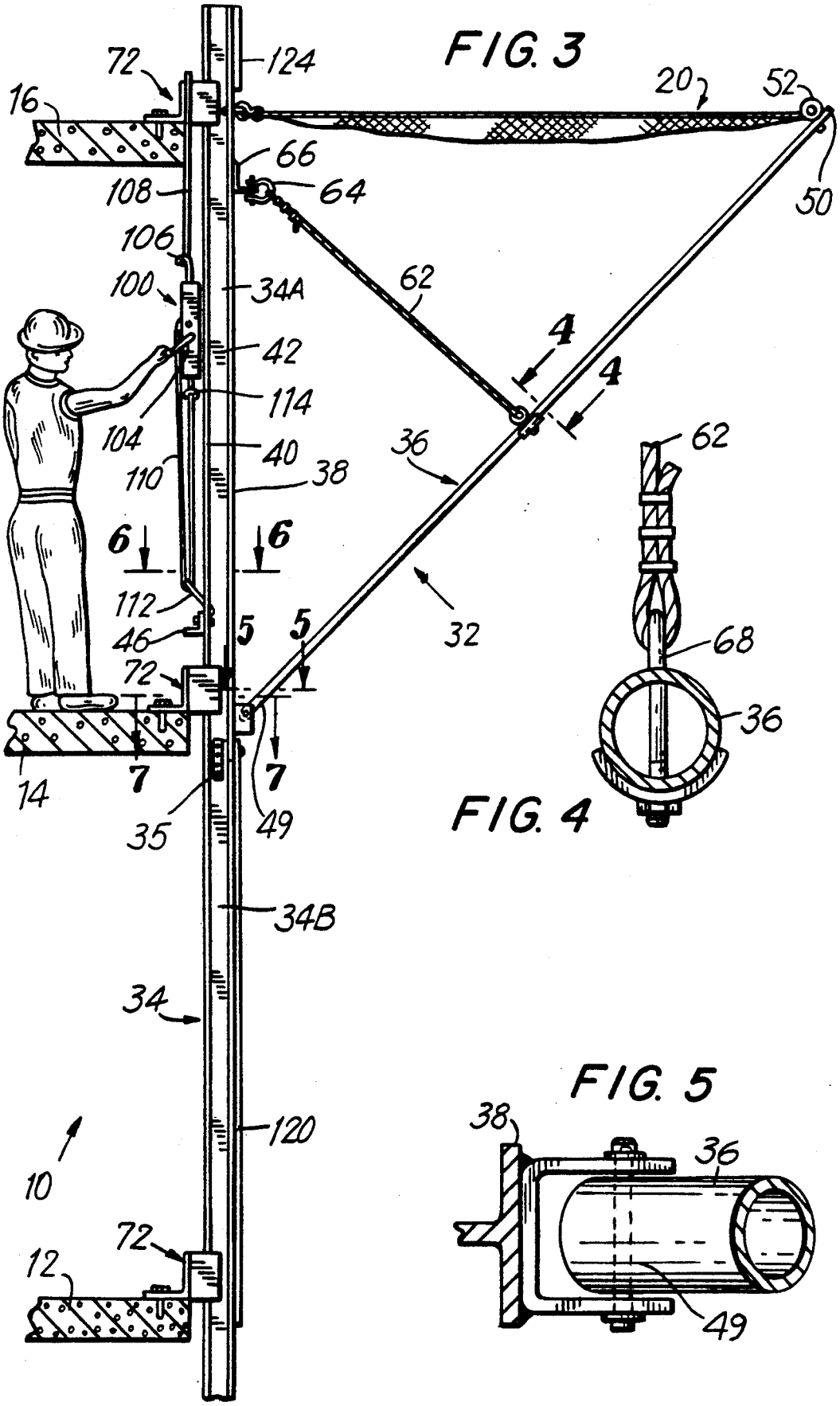
FIG. 4 is an enlarged, broken-away, sectional view taken on line 4—4 of FIG. 3.
FIG. 5 is an enlarged, broken-away, sectional view taken on line 5—5 of FIG. 3.

Each support structure 32 further includes an elongated cantilevered support 36 having an inner end region 49 pivotably mounted (see FIG. 5) at a central region of the upright support 34 with freedom to pivot toward the upright support 34 to provide a softer "catch" for a fallen worker and/or object. The cantilevered support has an outer end region 50 which carries a shackle 52 for engaging a cable or pole 54 which runs along the outer edge 22 of the net 20 in a direction which is generally parallel to the building face. Cable clamps 56 (see FIG. 2) connect the cable 54 to the cable edging 30 at spaced apart locations along the outer net edge 22.

Another cable or pole 58 (see FIG. 2) runs along the inner edge 24 of the net and in a direction that is generally parallel to the building face. Cable 58 is strung tautly between adjacent support structures 32. Similarly, the aforementioned cable 54 is tautly strung between the outer end regions 50 of two adjacent support structures 32. The cable edging 30 at the inner net edge 24 is connected by additional clamps 60 to the cable 58.

Each support structure 32 further includes a flexible cable 62 having one cable end connected to a respective upright support 34 at a shackle 64 pivotably mounted on an L-shaped bracket 66 bolted on the upright support 34, as well as an opposite cable end connected to a respective cantilevered support 36 at an eye-bolt 68 (see FIG. 4) extending through the support 36. Each cable 62 extends downwardly from the support 34 to a central region of the support 36. The flexibility of each cable 62, together with the pivotability of each support 36, cooperate to receive a fallen worker with a "softer" landing.

A bracing cable 70 extends from the upright support 34 of one of the support structures underneath the net in an upward direction outwardly of the outer face of the building, to the cantilevered support 36 of the other of the support structures to resist side-sway.

As best shown in the fully deployed condition illustrated in FIGS. 1-3, the net 20 is suspendably held at each end region by the upright support 34, the cantilevered support 36, and the flexible cable 62. This enables the fully deployed net to perform its intended purpose of protecting workers and passersby.

Returning to FIG. 1, a plurality of holders or guides 72 are attached to the building adjacent its outer face. The holders 72 are operative for holding each upright support 34 at discrete locations spaced apart lengthwise of a respective upright support.

Figure 8:
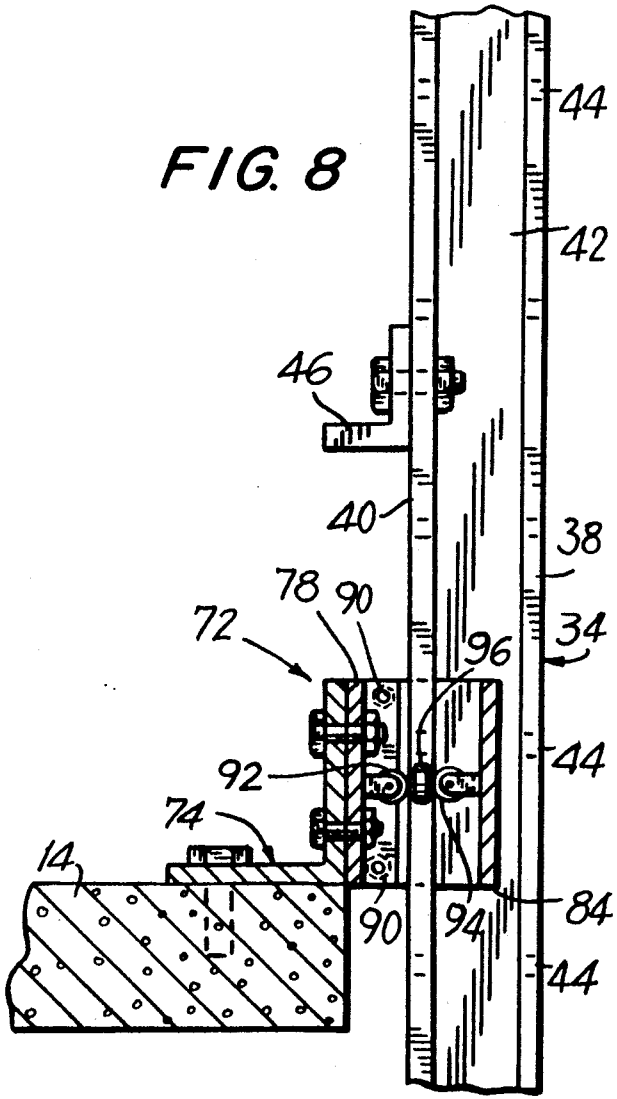
FIG. 8 is an enlarged, broken-away, sectional view taken on line 8—8 of FIG. 7.
Figure 7:
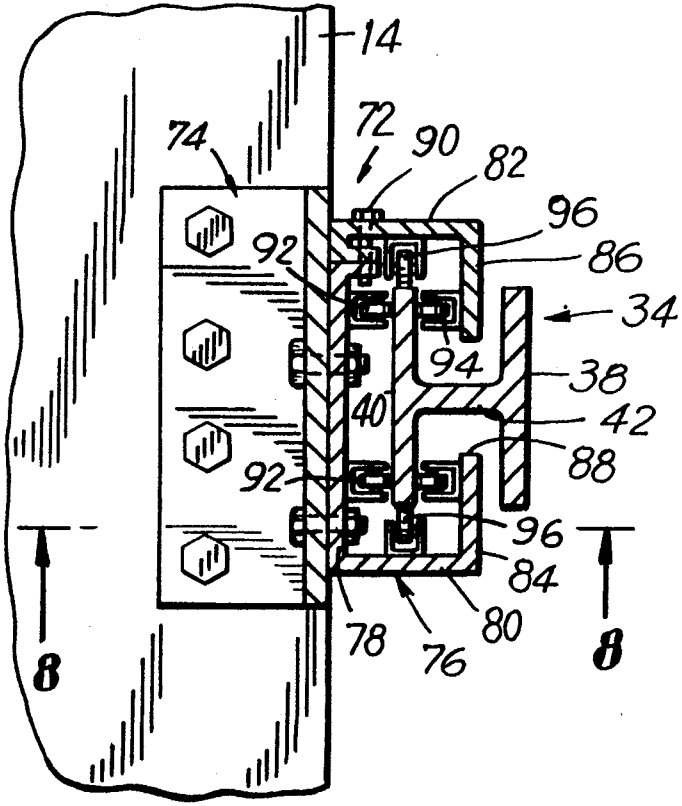
FIG. 7 is an enlarged, broken-away, sectional view taken on line 7—7 of FIG. 3.

As shown in FIGS. 7 and 8, each holder 72 includes a floor-mounted L-shaped bracket 74 and a housing cage 76 mounted on the upright leg of the bracket 74. Cage 76 includes a base wall 78, end walls 80, 82, and front walls 84,86. Front walls 84,86 are coplanar, and bound a clearance passage 88 that is sufficient for the web 42 of the support 34 to pass with clearance, but insufficient for the flanges 38,40 of the support 34 to pass therethrough. Front wall 86 and end wall 82 together constitute a removable wall so that each upright support 34 may be conveniently insertably received within the interior of the cage in a direction generally transverse to the elongation of the upright support 34. In other words, rather than inserting each upright support 34 endwise from above or below individual holders 72, it is less awkward and more convenient to move the upright support in a direction generally normal to the outer building face and to insert the upright support laterally from the sides of the cage made accessible upon removal of the removable wall 82, 86. Bolts 90 enable the removable wall 82, 86 to be easily attached and reattached to the cage 76.

A set of anti-friction rollers mounted within each cage rollably engage at least one of the flanges of the upright support. Rollers 92, 94 respectively engage the rear and front surfaces of the flange 40. Rollers 96 engage the end edges of the flange 40. The rollers 92, 94, 96 rollably guide each upright support for vertical movement.

A pair of manually-operated winches 100, 102, each operatively connected to a respective support structure 32, is manually operated by a worker (see FIG. 3) for manually moving the support structures independently of each other and in alternate succession to different elevations while maintaining the net in the fully deployed condition during each movement. Each winch has a handle 104 located below the deployed net to enable the worker to operate the winch from a protected position in which the overhead deployed net shields the worker from injury due to objects and/or workers falling from above.

Figure 6:
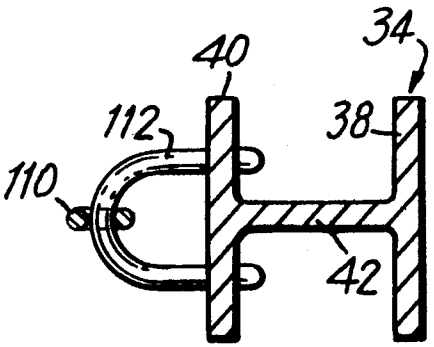
FIG. 6 is an enlarged, sectional view taken on line 6—6 of FIG. 3.

Each winch includes an upper mount or hook 106 and a support cable 108 looped around or otherwise securely connected to the holder 72 mounted on upper floor 16. The cable 108 engages the hook 106 and positions the winch handle 104 at a convenient height accessible to the worker above the lower floor 14, but, again, below the net 20. Each winch includes a coiled rope 110 wound around a pulley. The free end of the rope 110 is routed downwardly through a U-shaped shackle 112 (see FIG. 6) and thereupon upwardly to a lower mount or eye-bolt 114 on the bottom of the winch. The shackle 112 is rigidly connected to the upright support 34. Cranking the handle 104 causes the pulley to wind up the rope, effectively shortening its length, and pulling the shackle 112 and the upright support 34 upwardly. Each winch is preferably a one-way device permitting only upward movement.

In operation, the worker walks up to the winch 100, cranks its handle, and moves the support structure 32 at one end region of the net upwardly a few feet. Thereupon, the worker walks up to the other winch 102, cranks its handle, and moves the support structure at the opposite end region of the net upwardly a few feet to either the level of the first support structure or preferably a few feet higher. The worker then returns to the winch 100, continues the above-described procedure and, in effect, "walks" the net up the building. Of course, two workers, each manning a separate winch, could also be employed. In either event, the worker or workers are always operating their respective winches from a protected position underneath the deployed net 20. From this protected position, the net can be moved up several floors before the winches are removed from their supporting cables 108 and reattached at a higher floor. The aforementioned rollers greatly reduce the friction forces encountered during such movement.

The aforementioned stops 46 serve as positive fail-safe locking devices. As best shown in FIG. 8, should the net support structures fail, then the net and its supporting structures will only fall a few feet until the stops 46 abut against the tops of the adjacent holders 72. The stops 46 are removable and replaceable every few feet during raising of the net, especially to clear overhead holders. Hence, the net can fall, at worst, only a few feet.

Referring, again, to FIG. 1, this invention contemplates providing a plurality of the aforementioned nets 20, and arranging the same along an entire side and along all the sides of the building 10. Additional nets 20A, 20B are supportably held in approximately the same plane as net 20 in order to provide a continuous, uninterrupted net to arrest falls. Rather than providing a separate support structure 32 at the end of each net, each support structure may conveniently support two adjacent end edges of neighboring nets. The aforementioned cables 56, 58 are tautly strung continuously between and along such neighboring nets.

FIG. 1 also shows a curtain 120 mounted on the support structures for joint movement therewith. Curtain 120 is attached to, and extends, preferably in a stretched, taut condition, between adjacent upright supports 34. Fasteners 122 receivable in holes 40 secure the curtain 120 to the upright supports 34. Curtain 120 may be located underneath the net 20 or, as shown in FIG. 3, auxiliary curtain 124 is mounted on the upright supports 34 above the net 20. The curtain may bear graphics such as advertising information 124 on its exterior surface, thereby serving as a banner.

The curtain may extend for half a floor height or preferably a full floor height. The curtain may be made of a tarpaulin material to act as a weather shield, to keep heat within the building, or simply as a screen to keep spray paint and spray fire-proofing material within the building. No matter what its height, the curtain serves as a safety barrier to prevent workers from falling off the building underneath the net. When positioned above the net, the curtain serves as a convenient barrier for demolition debris to prevent the latter from collecting on the net and perhaps injuring a worker who falls into such debris.

The upright and cantilevered supports 34, 36 are advantegeously constituted of lightweight aluminum material to enable a worker to install, manipulate and remove the supports 34, 36, as well as all other components of the arrangement, without having to rely on power-assisted devices such as cranes.

Figure 10:
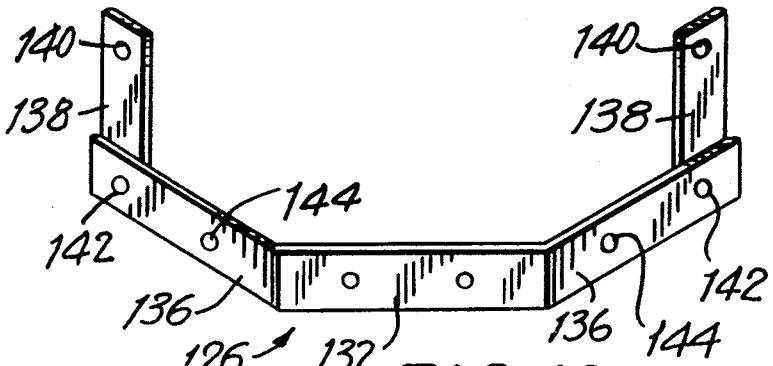
FIG. 10 is a perspective view of the bracket of FIG. 9.
Figure 9:
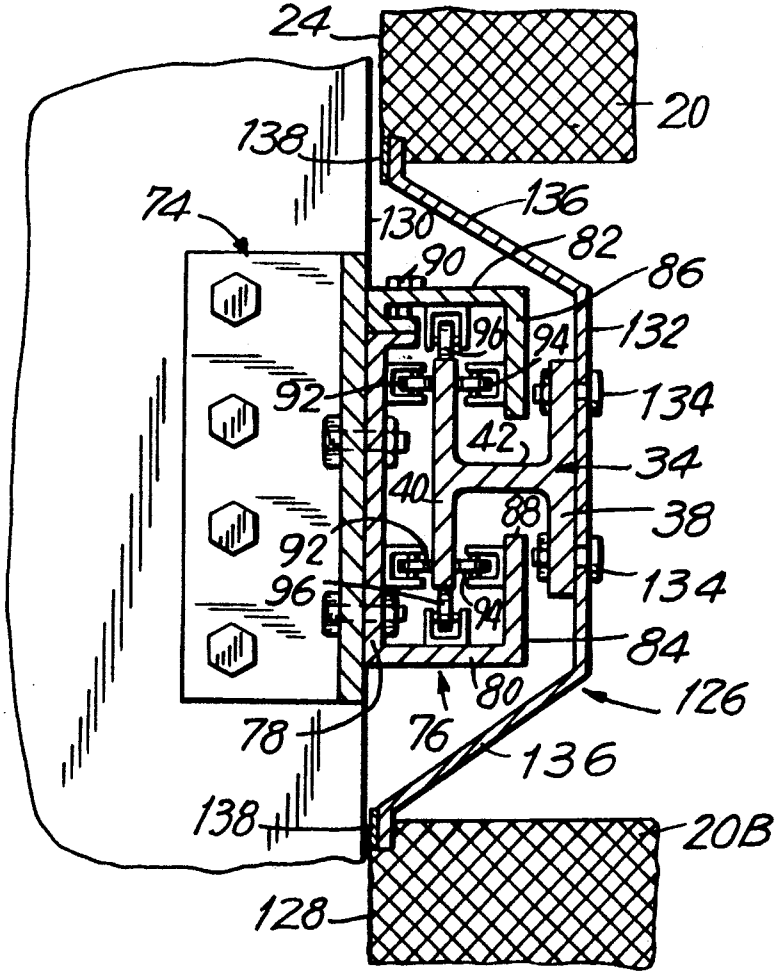
FIG. 9 is a view analogous to FIG. 7 showing a close-in mounting bracket for the inner edge of the net.

Turning now to FIGS. 9 and 10, a close-in mounting bracket 126 is mounted on each upright support 34 to bring the inner net edge 24 of net 20, as well as the inner net edge 128 of neighboring net 20B, closer in to the outer face 130 of the building. As previously described, the inner net edge was no closer to the outer building face 130 than the outer flange 38 of the upright support 34. This left a gap on the order of six to eight inches—a gap large enough for some objects, e.g. rivets, tools, etc., to fall through and constitutes a non-negligible safety risk.

The bracket 126 includes a planar base wall 132 directly mounted on each outer flange 38 by bolts 134. If a pair of bolts 134 is employed, then the single holes 44 in the upright support 34 would be replaced by pairs of such holes. Rearward planar wings 136 extend rearwardly of the base wall 132 at 45° angles toward the building face 130. Upright planar extensions 138 extend upwardly of the wings 136. The inner net edges 24, 128 are attached to selected mounting holes 140, 142, 144. Due to the rearward extension of the wings, the inner net edges are much closer to the building face 130, thereby minimizing this potential danger.

It will be understood that each of the elements described above, or two or more together, also may find a useful application in other types of constructions differing from the types described above.

While the invention has been illustrated and described as embodied in a jointly movable safety net and curtain arrangement for multi-floor buildings under construction, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A safety net arrangement for multi-floor buildings under construction, comprising:

(a) a safety net having opposite end regions;

(b) a pair of movable support structures, each supporting a respective end region of the net, for supporting the net in a deployed condition in which the net extends generally outwardly away from an outer face of a building under construction over a predetermined distance;

(c) a plurality of guides mounted on the building adjacent the outer face, for guiding the support structures for vertical movement along the outer face; and (d) a pair of manually-operated winches, each operatively connected to a respective support structure, for manually moving the support structures independently of each other and in alternate succession to different elevations while maintaining the net in the deployed condition during each movement, each winch having a handle located below the net in the deployed condition to enable an operator to operate the winch from a safe protected position in which the net shields the operator from injury.

2. The safety arrangement as recited in claim 1, wherein the safety net has inner and outer peripheral edges; and wherein each support structure has an upright elongated support operatively connected to the inner edge of the net and positioned adjacent the outer face, and a cantilevered support on the upright support and extending generally outwardly therefrom away from the outer face, said cantilevered support being operatively connected to the outer edge of the net; and wherein the guides engage and hold each upright support at discrete locations spaced apart lengthwise of the respective upright support.

3. The safety arrangement as recited in claim 2, wherein each support structure includes a flexible cable having one end connected to a respective upright support, and an opposite end connected to a respective cantilevered support, each cable extending downwardly from the respective upright support to a central region of the respective cantilevered support.

4. The safety arrangement as recited in claim 2, wherein each upright support has a length that spans the vertical distance between at least two floors of the building, and is mounted for rolling movement in the guides.

5. The safety arrangement as recited in claim 4, wherein each upright support includes two discrete beams connected together in an end-to-end relationship.

6. The safety arrangement as recited in claim 2, wherein each upright elongated support is received in a respective guide in a direction generally transverse to the elongation of the respective upright support.

7. The safety arrangement as recited in claim 6, wherein each guide includes a floor-mounted bracket attached to a housing cage exteriorly of the building face, each cage having a removable wall past which an upright support is received into the cage.

8. The safety arrangement as recited in claim 7, wherein each upright support has an H-shaped cross-section having generally planar flanges, and wherein each support structure includes a set of rollers within each cage for rollably engaging at least one of the flanges of a respective upright support.

9. The safety arrangement as recited in claim 2; and further comprising stop means removably mounted on each upright support above a respective guide, for affirmatively preventing the support structures from falling to the ground.

10. The safety arrangement as recited in claim 2; and further comprising a bracing cable extending from the upright support of one of the support structures, outwardly of the outer face of the building, to the cantilevered support of the other of the support structures.

11. The safety arrangement as recited in claim 2, wherein each winch includes a support cable extending downwardly from an upper floor and supportably engaging the winch.

12. The safety arrangement as recited in claim 2, wherein each winch includes a rope wound around a pulley operated by a respective handle, each rope being connected to a respective upright support at a location below the respective handle.

13. The safety arrangement as recited in claim 2; and further comprising a curtain mounted on, and extending between, the upright supports.

14. A safety arrangement as recited in claim 1; and further comprising a plurality of nets, support structures, guides and winches surrounding the periphery of the building.

15. A safety arrangement as recited in claim 2, wherein each support structure has a close-in bracket mounted on the upright support, each bracket having a wing extending toward the outer face of the building, said wing having an attachment to which the inner edge of the net is fastened.

16. A safety net arrangement for multifloor buildings under construction, comprising:

(a) a safety net having opposite end regions;

(b) support means for supporting the net in a deployed condition in which the net extends generally outwardly away from an outer face of a building under construction over a predetermined distance, said support means including a pair of support structures, each supporting a respective end region of the net;

(c) means for vertically moving the support means and the net in the deployed condition along the outer building face; and (d) a curtain mounted on the support means and extending between the support structures above the net for joint movement therewith.

17. The safety net arrangement as recited in claim 16, wherein the net has opposite end regions; and wherein the support means includes a pair of support structures, each supporting a respective end region of the net; and wherein the curtain extends between the support structures.

18. The safety net arrangement as recited in claim 13, wherein the curtain is mounted to the support structures underneath the net.

19. The safety net arrangement as recited in claim 13, wherein the curtain is mounted to the support structures above the net.

20. The safety net arrangement as recited in claim 16, wherein the curtain has graphics.

21. A safety net arrangement for multi-floor buildings under construction, comprising:

(a) a safety net having opposite end regions;

(b) a pair of movable support structures, each supporting a respective end region of the net, for supporting the net in a deployed condition in which the net extends generally outwardly away from an outer face of a building under construction over a predetermined distance, each support structure including (i) an upright elongated support positioned adjacent the outer face, (ii) a cantilevered support pivotably mounted on the upright support, and extending generally outwardly therefrom away from the outer face, and (iii) a flexible cable strung between the supports and extending downwardly from the upright support to the cantilevered support; and (c) means for vertically moving the support structures and the net in the deployed condition along the outer face of the building.

22. The safety net arrangement as recited in claim 13, wherein the curtain has graphics.

* * * * *